United States Patent [19]

Sheldon

[11] Patent Number: 4,744,681

[45] Date of Patent: May 17, 1988

[54] FORM PRINTER

[76] Inventor: Dunstan P. Sheldon, 1752 E. Altadena, Altadena, Calif. 91001

[21] Appl. No.: 32,535

[22] Filed: Apr. 1, 1987

[51] Int. Cl.[4] ..... B41J 3/12

[52] U.S. Cl. ..... 400/121; 101/93.05; 400/636.1

[58] Field of Search ..... 400/121, 611, 636, 636.1; 101/93.04, 93.05

[56] References Cited

U.S. PATENT DOCUMENTS

| | | | |
|---|---|---|---|
| 1,973,589 | 9/1934 | Watson . | |
| 2,971,627 | 2/1961 | Feissel . | |
| 3,065,835 | 11/1962 | Drillick . | |
| 3,628,645 | 12/1971 | McFeaters | 400/328 X |
| 4,069,755 | 1/1978 | Beery | 400/124 X |
| 4,074,797 | 2/1978 | Lewis . | |
| 4,195,940 | 4/1980 | Rekewitz | 400/568 |
| 4,196,665 | 4/1980 | Rogerts et al. | 101/93.05 X |
| 4,242,003 | 12/1980 | Ragen | 400/124 |

*Primary Examiner*—Paul T. Sewell

*Attorney, Agent, or Firm*—William W. Haefliger

[57] ABSTRACT

A form printer comprises:

(a) a feed plate adjacent which a form is fed in a longitudinal feed direction;

(b) a print head for printing the form;

(c) a first drive roller or rollers at one longitudinal side of the print head, and a second drive roller or rollers at the opposite longitudinal side of the print head, the drive rollers adapted to move the form longitudinally;

(d) a drive to drive the rollers in one mode to feed the form longitudinally forwardly, and then longitudinally reversely, to enable the print head to print on relatively widely spaced zones of the form.

11 Claims, 4 Drawing Sheets

FIG. 1.
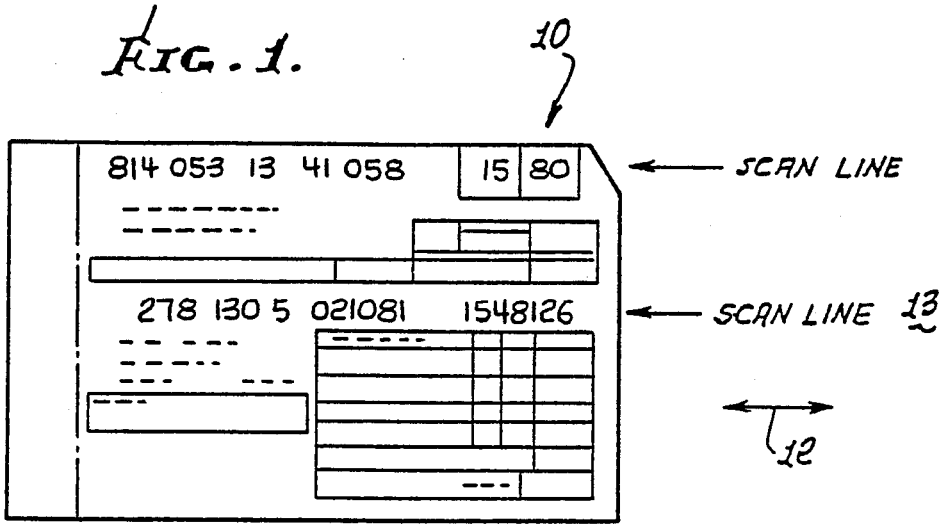
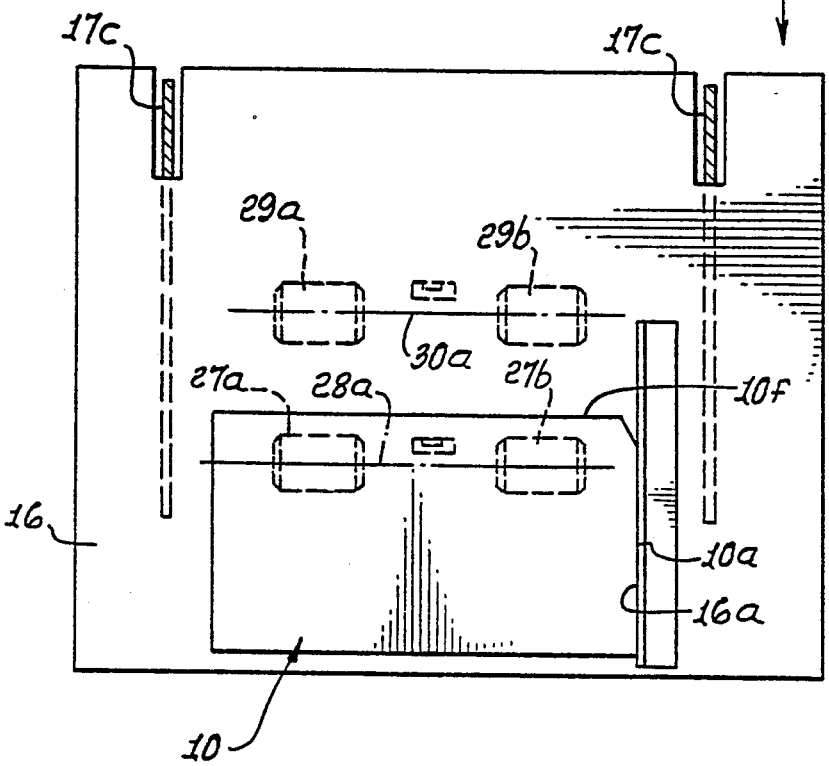
FIG. 4.

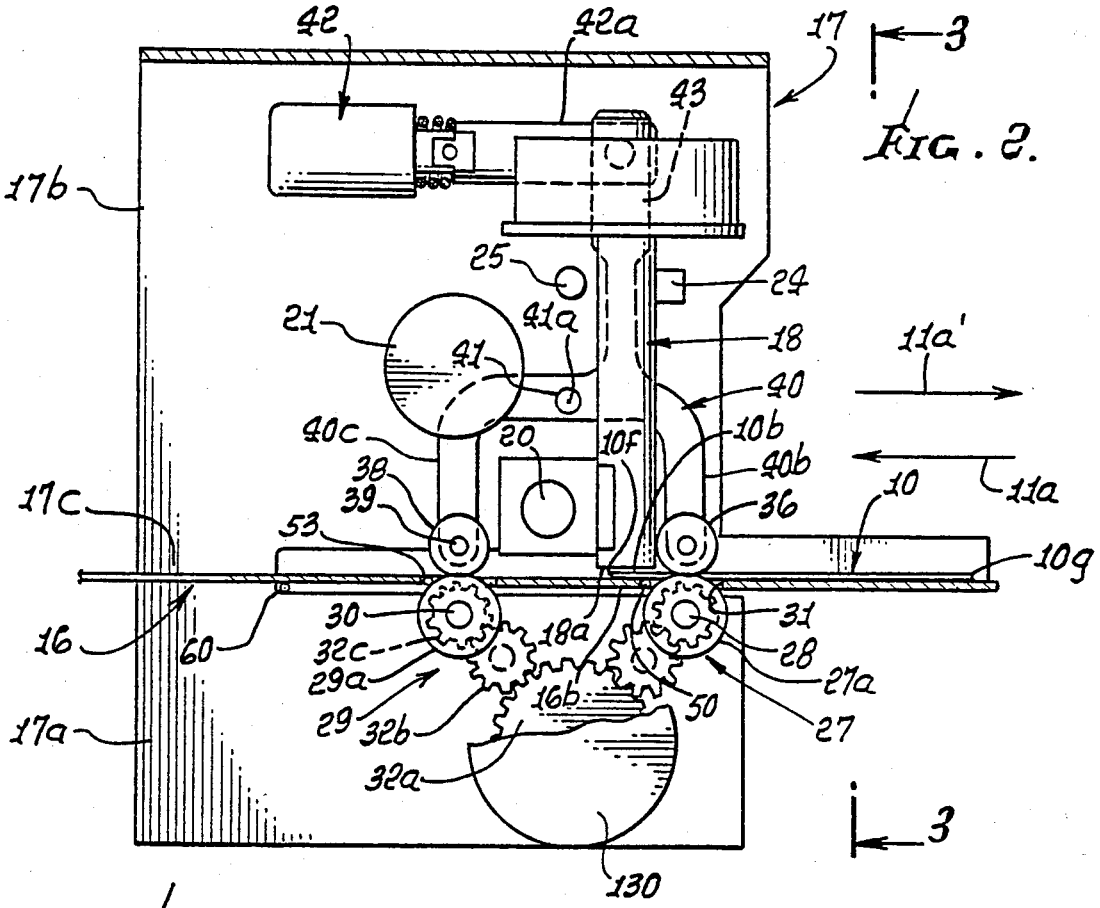
FIG. 2.
FIG. 3.
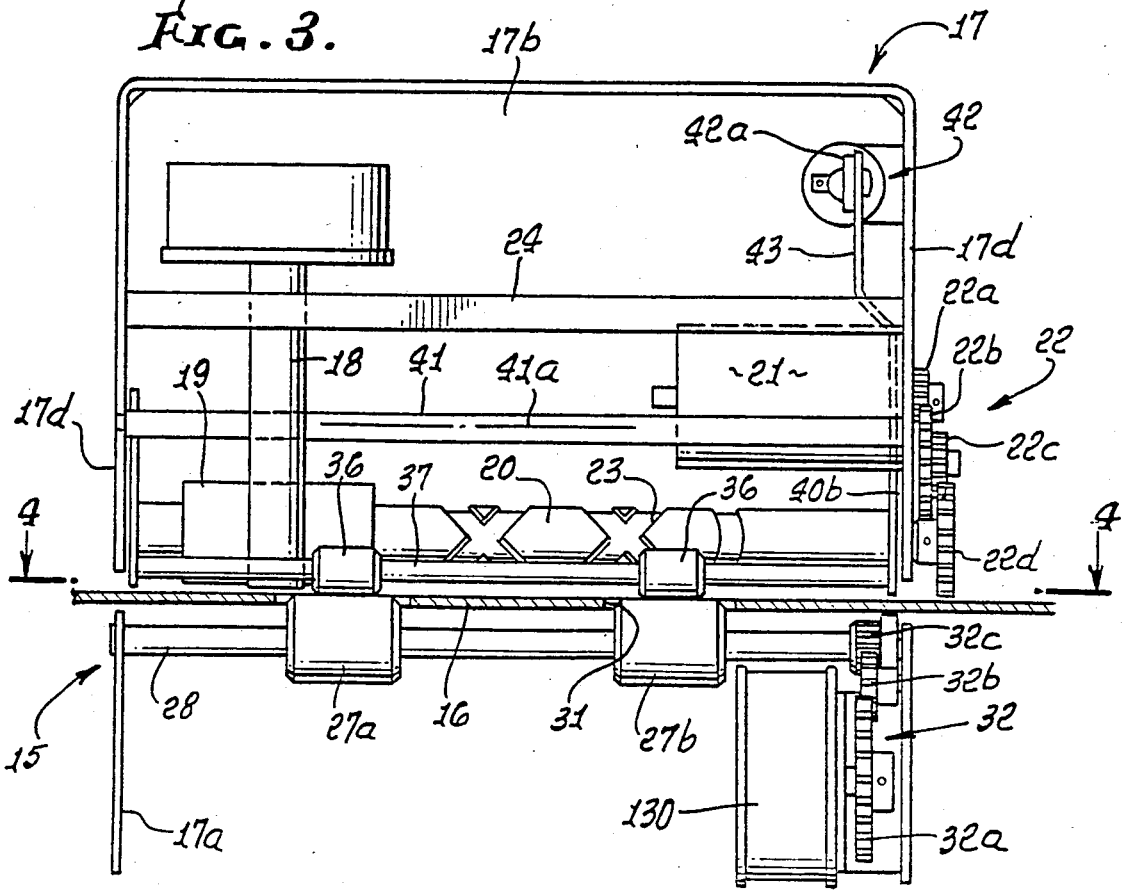

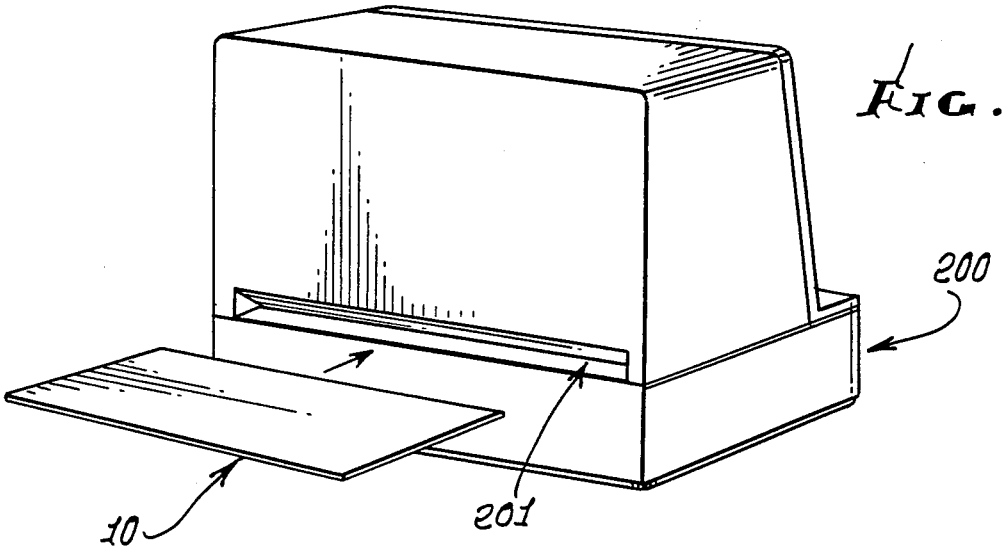
FIG. 8.
FIG. 9.
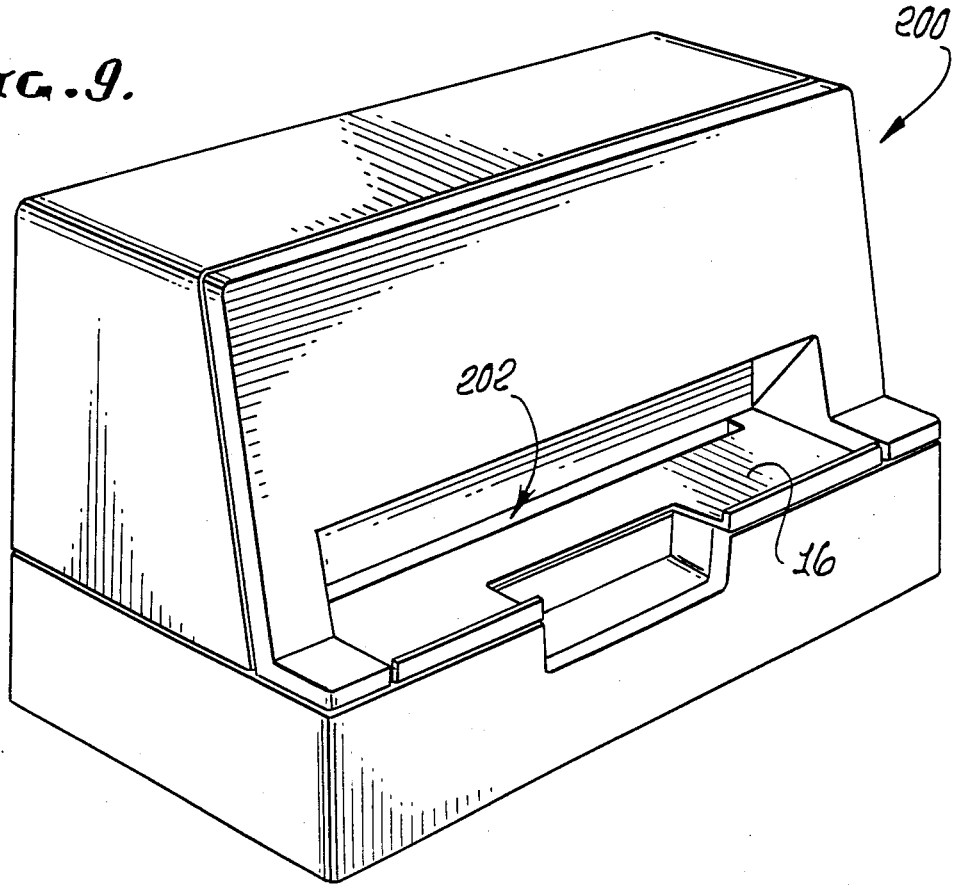

FORM PRINTER

BACKGROUND OF THE INVENTION

This invention relates generally to form printing, and more particularly concerns the provision of a printer characterized as enabling printing of a standard credit card sales draft, as well as other forms, employing a dot matrix print head.

Certain disadvantages and problems with current commercial printers are listed as follows:

(1) Current printers are limited to a 40 alphanumeric character print line which is normally 3.3 to 3.6 inches long;

(2) Current printers have feed rollers positioned behind the print platen or head, and do not allow for convenient entry and feeding of relatively small forms;

(3) Current printers are constructed with a form entry slot or opening at the left side of the printer (relative to a user addressing the machine from the front), which does not allow for printing on the left extent of a form which more than 3.3 inches wide;

(4) Conventional line spacing is accomplished by means of a ratchet feed mechanism which does not permit complete flexibility of printing of relatively large characters (i.e. taller than the seven dot matrix head).

In addition, prior printers do not provide the unusually advantageous features and combinations of structure, function and result embodied in the present invention.

SUMMARY OF THE INVENTION

It is a major object of the invention to provide a printer overcoming the above disadvantages and problems associated with conventional and prior printers. Basically, the invention is embodied in a form printer which includes, in combination:

(a) a feed plate adjacent which a form is fed in a longitudinal feed direction, (b) a print head for printing the form on the plate, (c) first drive roller means at one longitudinal side of the print head, and second drive roller means at the opposite longitudinal side of the print head, said drive rollers adapted to move the form longitudinally, (d) drive means to drive said rollers in one mode to feed the form longitudinally forwardly and then longitudinally reversely to enable the print head to print on relatively widely spaced zones of the form.

As will be seen the first drive roller means typically comprises laterally spaced apart rollers, and the second drive roller means also comprises laterally spaced apart rollers. In addition, first pinch roller means may be located to urge the form against the first drive roller means, and second pinch roller means located to urge the form against the second drive roller means. Actuator means are also provided to selectively urge the first and second pinch roller means relatively toward the first and second drive roller means, respectively.

It is another object of the invention to provide for the control of the drive of the first and second drive rollers. To this end, a first sensor is positioned to sense the edge of a form that has passed longitudinally forwardly between the first drive roller means and first pinch roller means, and operatively connected with the actuator means to cause the actuator means to urge the first pinch roller means toward the first drive roller means to pinch the form therebetween, whereby the first drive roller means then drive the form longitudinally forwardly. Also, a second sensor is positioned to sense the edge of a form that has passed longitudinally forwardly between the second drive roller means and second pinch roller means, and operatively connected with the actuator means to cause the actuator means to urge the second pinch roller means toward the second drive roller means to pinch the form therebetween, whereby the second drive roller means then drives the form longitudinally forwardly.

In addition, the drive means to drive the rollers typically comprises a stepper motor operable to alternatively travel the form forwardly or rearwardly during travel intervals and to arrest form advancement during arrest intervals, to enable printing on the form by the print head during the arrest intervals.

The printer typically includes a dot matrix printer characterized in that the dots printed on the form to delineate an alphanumeric character are successively located to merge with one another and form character lines. In addition, the printer and apparatus may be further characterized in that the character forming dots form first portions of a line of characters during an arrest interval in forward travel mode and the dots form other portions of of said line of characters during an arrest interval in reverse travel mode.

As a result, the following unobvious advantages or results are provided:

(a) The invention permits the provision of a longer print line (as for example 4.25 inches) and more (such as 51–55) characters per line, as compared with a standard printer;

(b) the dual drive roller feature of the invention allows forms to be fed into the printer over front rollers prior to feeding under the print head, so that forms can be printed over substantially all of the form area;

(c) the forms can be positioned either to the left or to the right of the print line permitting printing on the left or right side of the form;

(d) use of a stepper motor for the feed roller drive enables use of software control permitting complete flexibility of line spacing, i.e. larger or smaller line widths, in the direction of form feeding, (e) a highly efficient, compact, versatile and flexible printer construction is provided, as will appear.

These and other objects and advantages of the invention, as well as the details of an illustrative embodiment, will be more fully understood from the following specification and drawings, in which:

DRAWING DESCRIPTION

FIG. 1 is a plan view of one type of form to be printed;

FIG. 2 is a side elevational view of apparatus embodying the invention;

FIG. 3 is a first elevational view taken on lines 3—3 of FIG. 2;

FIG. 4 is a top plan view taken in section on lines 4—4 of FIG. 3;

Figure 7:
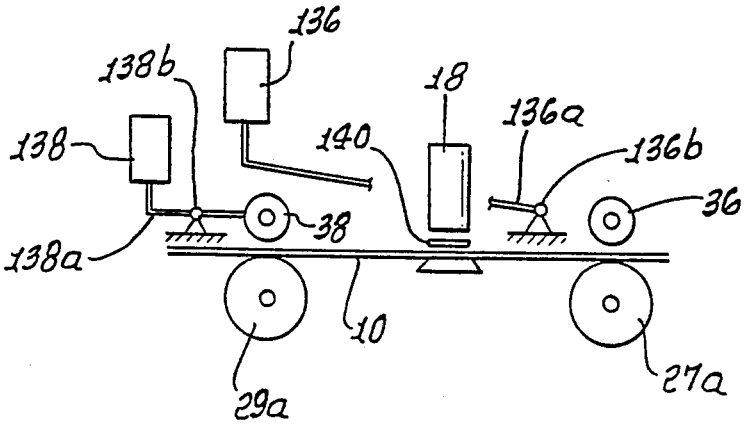

FIGS. *6a–6c* are enlarged plan views of formation of an alphanumeric character, by printed dots; and FIG. 7 is a modification;

FIGS. 8 and 9 are perspectives.

DETAILED DESCRIPTION

Figure 6A:
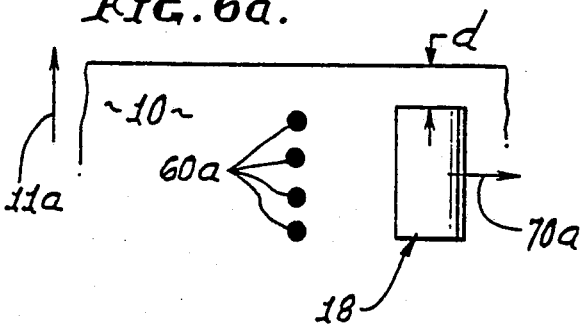
Figure 6B:
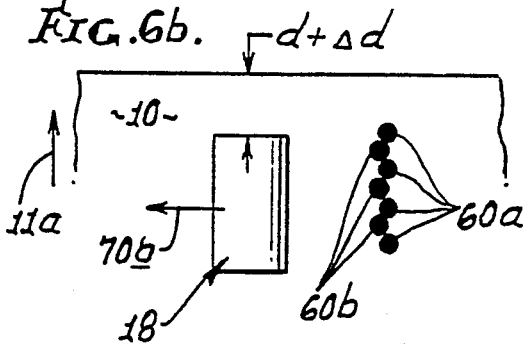

The form shown at 10 in FIG. 1 (which may comprise a standard credit card sales draft) has longitudinally spaced, laterally extending printed lines of printed alphanumeric characters. See longitudinal directional arrows 11, and lateral directional arrows 12. By way of illustration, the number "7" in the scan line 13 of characters may be formed by printed dots which merge together, as seen in FIG. 6. The dots appear at 60*a*.

Extending the description to FIGS. 2–4, the form 10 is shown as being fed forwardly, in the longitudinal direction of arrow 11*a* by or in a form printer apparatus 15. The latter includes a feed plate 16 on which the form is placed downwardly, the plate extending horizontally. To this end, the edge 10*a* of the form may be placed in engagement with longitudinally forwardly extending guide flange 16*a* shown in FIG. 4, that flange carried by the plate. The plate is in turn carried by frame structure 17 which includes a lower portion 17*a* an upper portion 17*b*, and structure 17*d* interconnecting the portions 17*c* and 17*b*. Upright structure 17*c* is confined to a forward zone beyond drive roller means (to be described), whereby lateral movement of the form on the feed plate, and over the drive roller means is essentially unobstructed. (The guide flange 16 may be re-positioned or removed, to allow such form lateral movement, whereby all surface areas of the form may be printed, if desired. Thus, the frame has a "C" shaped construction, as is clear from FIG. 2.

A print head 18 is carried by the printer frame, and in particular by upper portion 17*b* thereof, so as to print on the form located on the feed plate. Note the lower print end 18*a* of the head, directly over the form extent 10*b* in FIG. 2. A print platen may be located at or associated with that portion of the plate indicated at 16*b*, beneath the print head. The print head is supported to traverse laterally over the form, to print thereon as during "dwell" intervals, defined as intervals of non-advancement or nonretraction of the form. Such support may be provided as by a follower sleeve 19 carried on a lateral feed screw 20 supported by the vertical end walls 17*d* of the frame structure portion 17*b*. The screw 20 is rotatably driven as by motor 21 and transmission 22 (including gears 22*a*–22*d*). Helical external cam shoulders 23 on the screw mesh with corresponding interior shoulders (not shown) on the follower, to travel the follower back and forth along the screw, during operation of the print head. See also lateral guide bars 24 and 25 between which the print head structure travels. The print head may be dot matrix impact type, one representative model M-400 produced by ETN Printer Products of Riverton, WY. Another is model 542 produced by Epson Company of America.

In accordance with the invention, first drive roller means 27 (as for example laterally spaced drive rollers 27*a* and 27*b* on common shaft 28) is located at one longitudinal side of the print head; and second drive roller means 29 (as for example laterally spaced drive rollers 29*a* and 29*b* on common shaft 30) is located at the longitudinally opposite side of the print head, the drive rollers adapted to displace or move the form 10 longitudinally. The shaft axes appear at 28*a* and 30*a*, in FIG. 4, and they extend in parallel relation, laterally, and are longitudinally spaced apart. The rollers project upwardly in openings 31 in the feed plate 16, as shown, to engage the underside of the form 10.

Also provided is drive means to drive the rollers 27 and 29 in one mode (as for example counterclockwise in FIG. 2) to feed the form 10 longitudinally forwardly under the print head (to enable printing of all or widely spaced areas of the forms) and then longitudinally reversely, for form retrieval, and/or additional printing on the form. The drive means may advantageously comprise a stepper motor, shown at 130, operable to alternatively drive the form forwardly and reversely during travel intervals, and to arrest form advancement (or retraction) during arrest intervals to enable printing on the form by the print head and during the arrest intervals. The motor is typically connected with both drive rollers, as for example by the gearing at 32, and including gears 32*a* and 32*b* and 32*c*. Operation of the motor (ON, OFF, FORWARD, and REVERSE) is controlled as via lead 33 by controller 34, shown in FIG. 5.

Also provided is first pinch roller means (as for example pinch rollers 36 on shaft 37) located directly above the first drive rollers 27*a* and 27*b* to urge the form against the latter; and second pinch roller means (as for example pinch rollers 38 on shaft 39) located directly above the second drive rollers (29*a* and 29*b*) to urge the form against those second drive rollers and pinch the form therebetween, whereby one or the other of the drive rollers urges the form longitudinally forwardly and longitudinally reversely (depending upon the direction of rotation of the drive rollers). For this purpose, the pinch rollers may be carried by a yoke 40 which is rocked about lateral axis 41*a* (see lateral shaft 41 in FIGS. 2 and 3) as by a solenoid 42. The latter has a plunger and link 42*a* connected with arm 43 which is integral with the yoke arms 40*b* and 40*c*. When the solenoid 42 is activated (as by controller 34 and lead 44) in one direction, the yoke is rocked clockwise in FIG. 2, to cause pinch rollers 36 to urge the form 10 against the rollers 27*a* and 27*b*, whereby the form is driven by such rollers; and when the solenoid is activated in the opposite direction, the yoke 40 is rocked counterclockwise in FIG. 2, to cause pinch rollers 38 to urge the form 1 against the rollers 29*a* and 29*b*, whereby the form is driven by those rollers. Rollers 38 are retracted relative to rollers 29*a* and 29*b* when rollers 36 are urged toward rollers 29*a* and 29*b*, and vice versa, leaving the form gripped by rollers 27*a* and 27*b*, or by rollers 29*a* and 29*b*, to ensure precision drive and form location relative to the print head. (In FIG. 2 both rollers 38 and 36 are shown in engagement with rollers 29*a* and 29*b* for simplification of the drawing.

A first sensor 50 is positioned to sense the passage of form forward edge 10*f* past the sensor (upon manual insertion of the form between rollers 27 and 36). That sensor is connected at 51 with the controller 34 and the latter with the actuator 42, to cause rocking of the yoke 40 and positive forward driving of the form by rollers 27*a* and 27*b*. When form leading edge 10*f* advances over rollers 29*a* it is sensed by a second sensor 53 at gap 32. That sensor is connected at 54 with the controller which causes rocking of the yoke 40 in the opposite direction to initiate further positive forward driving of the form to bring its near rear edge 10*g* under or nearly under the print head. In this way, the entirety (or near entirety) of the form is brought under the print head for printing thereon.

When the leading edge of the form reaches a sensor 60 (at which time rear edge 10*g* is near the print head as described), the sensor 60, connected at 61 with the controller, causes the controller to reverse the rotation of the drive motor 30, which then reversely drives the rollers 29*a*, 29*b*, 27*a* and 27*b*, to reversely drive the form from the printer.

Figure 5:
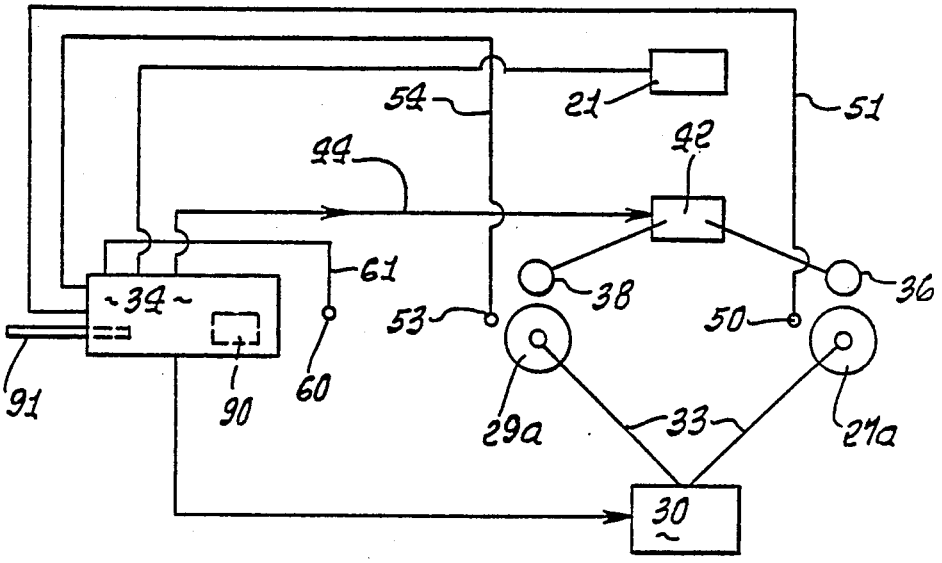
FIG. 5 is a circuit diagram.

The controller 34 may incorporate suitable fixed software 90 (or hardware) to command the print head motor 21, stepper motor 30, solenoid 42, in response to sensing of the form edges as by sensors 51, 53 and 60; and suitable variable software 91 to command the variable data printing accomplished by the print head 18. In regard to the latter, the printer and the variable software may be characterized in that character forming dots form a first portion of a character (or line of characters) during an arrest interval (or intervals) in travel mode of the printer in one transverse direction; and the dots form other portions of the line of characters during an arrest interval (or intervals in travel mode of the printer in the opposite transverse direction. See in this regard FIG. 6*a* wherein printed dots indicated at 60*a* are formed during an arrest interval of the form 10 while the print head 18 is traveled to the right (arrow 70*a*) by feed screw 20 (see FIG. 3) and on guide bars 24 and 25; and printed dots 60*b* are formed during a subsequent arrest interval of the form 10 in FIG. 6*b* while the head 18 is traveled to the left (arrow 70*b*) by screws 20. Dots 60*a* are spaced apart, but dots 60*b* merge with dots 60*a* to form a solid character, due to the indexing of the form 10 in the direction 11*a*. This is shown by the distance "d" of the printer from the form edge 10*c* in FIG. 6*a*, and the distance $d+\Delta d$ of the printer from the form edge 10*c* in FIG. 6*b*, where $\Delta d$ is the indexing distance. The controller 34 controls the drive 21 for the printer 18 as shown in FIG. 5.

Figure 6C:
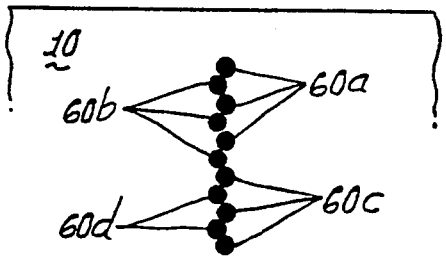

FIG. 6*c* shows dots 60*a* and 60*b* formed on a form as described above. Also, dots 60*c* are formed during a later rightward pass of the print head, and intermediate dots 60*d* are formed during a leftward pass of the print head (corresponding to formation of dots 60*b*). Thus, all the dots 60*a*–60*d* form one character, in response to two complete back and forth passes of the print head.

FIG. 7 schematically shows the two pinch rollers 36 and 38 operated by solenoids 136 and 138, as via levers 136*a* and 138*a*, suitably pivoted as at 136*b* and 138*b*. A print ribbon 140 is shown between the print head 18 and the form 10.

The stepper motor and controller 34 monitor the exact location of the form 10 relative to the print head to enable such exact printing, as facilitated by the precision engagement and drive of the form under the control of one or the other of the drive rollers, at all times.

In FIG. 2, a print ribbon (not shown) typically passes between the bottom 18*a* of the print head and the form.

Variations of the invention include the alternate drive of the print head 18 as by a belt drive, instead of the drive screw 20. Also, the frame can be constructed without closed ends. Other means for alternately driving the pinch rollers can also be provided; further, in view of the locating of the pinch rollers at opposite sides of the print head lower end 18*a*, and provision for oppositely rotating the pinch rollers, a form to be printed can be inserted or fed at either end of the feed plate, i.e. front or back. Finally, the device is accommoated to printing documents that are OCR (optical code readable) scannable—i.e. a carbon copy is scannable.

FIGS. 8 and 9 are rear and front perspectives of a typical housing 200 for the apparatus of FIGS. 1–3. Rear and front entrances and exits (depending on document direction of feed) appear at 201 and 202.

I claim:

1. In a form printer, the combination comprising (a) a feed plate adjacent which a form is fed in a longitudinal feed direction, (b) a print head for printing the form, (c) first drive roller means at one longitudinal side of the print head and second drive roller means at the opposite longitudinal side of the print head, said drive rollers adapted to move the form longitudinally, (d) drive means to drive said roller means in one mode to feed the form longitudinally forwardly and then in a second mode to feed the form longitudinally reversely to enable the print head to print on spaced zones on the form, (e) first pinch roller means located to urge the form against the first drive roller means, and second pinch roller means located to urge the form against the second drive roller means, and actuator means movable cyclically to selectively and alternately urge the first and second pinch roller means relatively toward the first and second drive roller means, respectively, (f) a first sensor positioned to sense the edge of a form that has passed longitudinally forwardly between the first drive roller means and first pinch roller means, and operatively connected with the actuator means to cause the actuator means to urge the first pinch roller means, toward the first drive roller means to pinch the form therebetween, whereby the first drive roller means then drives the form longitudinally forwardly, (g) the first roller means comprising laterally spaced apart rollers, and the second drive roller means also comprising laterally spaced apart rollers, (h) the drive means for the drive roller means comprising a stepper motor operable to alternately travel the form forwardly or reversely during travel intervals and to arrest form advancement during arrest intervals, to enable printing on the form by the print head during the arrest intervals, the stepper motor connected to both first and second drive roller means, (i) there being a second sensor positioned to sensor said edge of the sensor that has passed beyond the second drive roller means and second pinch roller means, and operatively connected with said actuator means to cause the actuator means to urge the second pinch roller means toward the second drive roller means to pinch the form therebetween whereby the second drive roller means then drives the form further longitudinally forwardly, thereby to bring a rear section of the form into registration with the print head, (j) and a third sensor positioned to sense said edge of the form that has passed further beyond the second drive roller means and second pinch roller means, and to a point corresponding to said registration of the rear section of the form with the print head, and operatively connected with said drive means for causing the drive means to drive the roller means in said second mode.

2. The combination of claim 1 wherein the print head includes a dot matrix printer.

3. The combination of claim 1 wherein the printer includes a dot matrix printer characterized in that the dots printed on the form to delineate an alphanumeric character are successively located to merge with one another and form character lines, and including said form and said dots thereon.

4. The combination of claim 3 wherein the printer is characterized in that the character forming dots form first portions of a line of characters during an arrest interval in travel mode of the printer in one transverse direction and the dots form other portions of said line of characters during an arrest interval in travel mode of the printer in the opposite transverse direction.

5. The combination of claim 4 including a frame carrying the printer for said transverse travel thereof, and other drive means to effect said travel of the printer in said one direction while the form is in a first arrested position and to effect said travel of the printer in said opposite direction while the form is in a second and subsequent arrested position.

6. The combination of claim 1 including a frame having a lower portion carrying the drive roller means and an upper portion carrying the print head, and structure connecting said upper and lower portions of the frame, said structure confined to a zone beyond the drive roller means in said forward feed direction, whereby lateral movement of the form on the feed plate is unobstructed.

7. The combination of claim 1 including rocking structure operatively connected between the actuator means and the pinch roller means to be rocked in one direction by the actuator means to urge the first pinch roller means toward the first drive rollers, and to be rocked in the opposite direction by the actuator means to urge the second pinch roller means toward the second drive rollers.

8. The combination of claim 1 including structure operatively connected between the actuator means and the pinch rollers to be displaced by the actuator means to first urge the first pinch roller means toward the first drive rollers, and to subsequently urge the second pinch roller means toward the second drive rollers.

9. The combination of claim 1 including a drive operatively connected with the print head to travel the print head laterally over the form to print thereon during intervals of rear-travel of the form longitudinally.

10. The combination of claim 9 wherein said drive includes cam and follower elements with helical intermeshing shoulders, above the longitudinal path of travel of the form between said first and second drive roller means.

11. The printer of claim 1 including a housing enclosing said (b) through (e) elements, the housing having front and rear walls and openings in said walls via which a form passes through the housing, the (a) feed plate in general registration with said openings.

* * * * *